United States Patent [19]

Assfalg

[11] Patent Number: 4,984,620

[45] Date of Patent: Jan. 15, 1991

[54] APPARATUS FOR MAKING MOLDS FOR MAKING METAL CASTINGS

[76] Inventor: Christina Assfalg, Mathystrasse 36, 7530 Pforzheim, Fed. Rep. of Germany

[21] Appl. No.: 355,678

[22] Filed: May 23, 1989

[51] Int. Cl.[5] ..... B22C 5/02

[52] U.S. Cl. ..... 164/160.1; 164/412; 164/35; 366/139; 366/338

[58] Field of Search ..... 164/7.1, 15, 35, 159, 164/160.1, 165, 166, 412, 521, 522, 516–519; 366/139, 338

[56] References Cited

U.S. PATENT DOCUMENTS 4,068,828 1/1978 Goins ..... 366/338

4,653,568 3/1987 Baldelli ..... 164/160.1

*Primary Examiner*—Richard K. Seidel

*Attorney, Agent, or Firm*—Spensley Horn Jubas & Lubitz

[57] ABSTRACT

The apparatus comprises two containers, which are adapted to be connected to a vacuum pump. The upper container contains a rotationally symmetrical guiding body. A distributing space is defined by the shell of the upper container and the closed peripheral surface of the guiding body and extends from the cover of the upper container to pipe lengths, which terminate at their lower end over cups arranged in the lower container. As a result, the apparatus permits an economical making of molds in series and meets the requirements arising in practice regarding the batchwise processing of batches in quantities which vary within an extremely wide range.

12 Claims, 5 Drawing Sheets

43
25
24
26
21
10
13
58
23
19
58
34
28
44
31
14
49
12
16
18
51
52
45
50
33
46
33
35
17a
55
17b
57
47
48
17
15
56
5

APPARATUS FOR MAKING MOLDS FOR MAKING METAL CASTINGS

BACKGROUND OF THE INVENTION

1. Field of the Invention

This invention relates to an apparatus for making molds for making metal castings, which molds are made from a liquid to pasty composition, which contains in an aqueous phase a binder and, in addition, at least one mineral solid substance, particularly cristobalite, said apparatus comprising two approximately concentrically arranged containers, which are arranged one over the other and adapted to be vacuum-tightly sealed and to be connected to a vacuum pump by lines which are adapted to be shut off, which apparatus also comprises a plurality of pipe lengths, which are arranged in a circular array and interconnect the containers and are adapted to be shut off by respective shut-off valves and serve to transfer the composition from the upper container into the lower container and have inlets, which are open at the bottom of the upper container to a distributing space, which is defined on one side by the cylindrical vertical shell of the upper container and on the other side by a flow guiding surface, and have outlets which are disposed in the lower container over respective cups, which are to be filled.

2. Description of the Prior Art

In a known apparatus of that kind the composition is mixed by means of rotating mixing members in the upper container under a reduced pressure and by said mixing members is also caused to flow or urged into the inlets of the pipe lengths. In the lower container the composition falls from the pipe lengths into the cups to fill the same also under a reduced pressure. The mixer is entirely disposed in the upper container and comprises a drive motor having an output shaft which extends almost as far as to the cover and which carries revolving stirring blades, which extend in a stirring compartment between the housing of the drive motor and the cylindrical shell of the upper vessel. By means of an at least partly perforate, profiled sheet metal element the stirring compartment is separated from a compartment that is disposed in the upper portion of the upper vessel and in which rotatable blades are disposed, which are mounted on the output shaft and can be operated to transfer a pulverulent mixture, e.g., of dry gypsum and cristobalite, from the upper compartment into the water-containing stirring compartment through the perforations of the profiled sheet metal element so that the composition can be formed in the lower compartment. Because the mixing members rotate in the upper container, the known apparatus must be filled to a relatively high degree if an intensive mixing of the composition is to be effected within a tolerable time and a cleaning of the apparatus with a reasonably small loss of material is to be permitted. But a processing of the composition also in small quantities will be required, e.g., in the making of small, high-quality casting molds, particularly if the setting time is shortened by the use of chemical accelerators.

It is also known to provide only one evacuated vessel for a venting of the cups when they are filled under atmospheric pressure. In that case the composition is formed by stirring under atmospheric pressure outside the evacuated vessel. Compared to the operation of the known filling apparatus which has been described first hereinbefore and in which the cups are filled at the same time the processing described in the second place, which is often adopted in small plants, involves a relatively high expenditure of time and labor.

SUMMARY OF THE INVENTION

It is an object of the invention so to improve a filling apparatus of the kind described first hereinbefore that it meets the requirements for an economical series production of molds and also meets the requirements arising in practice regarding the batchwise processing of quantities which vary within an extremely large range.

That object is accomplished in accordance with the invention in that an approximately rotationally symmetrical flow guiding body having a closed peripheral surface is concentrically disposed in the upper vessel and a distributing space, which is free of internal fixtures and is defined by the cylindrical shell of the upper container and the peripheral surface of the flow guiding body extends from the cover of the upper container to the inlets of the pipe lengths and terminates at said inlets as an annular mouth space.

In that arrangement the cups are filled in an evacuated filling container and a separate additional evacuated container is provided, which serves only to divide the composition into batches and to supply the composition to the cups under a vacuum and for this reason contains no mixing means at all. The additional container is a mere distributing and venting container, i.e., virtually a multiple hopper, for distributing the composition in proper batches to the cups. The residence time of the composition will depend on the consistency of the composition and on an optionally adjustable pressure difference between the filling container and the other evacuated container, which serves as a multiple hopper. A prolongation of that residence time by mixing means which might be required will inherently be avoided.

In that arrangement the division of the composition into batches for filling respective cups, which division is effected as the composition flows into the pipe lengths, and the filling operation proper are effected under a vacuum. The mixing of the components of the composition to form the latter is performed outside the evacuated space. This will result in the following advantages:

Stirring equipment which is most powerful and inexpensive can be used for the external mixing to form the composition. Such stirring equipment is available on the market as mass-produced equipment. Besides, the time required for the distribution in the upper container and for the filling operation in the lower container may be shortened so that the conditions for the use of chemical accelerators are improved. The distributing compartment, which is provided in the upper container and does not contain any rotating stirring member, is designed to permit a processing of batches of widely varying amounts so that the apparatus can comply with the processing requirements of a wider range of customers. On the other hand that advantage of the apparatuses of the kind described first hereinbefore which resides in that venting is effected during the distributing and filling operations is preserved as well as the possibility to suck pasty compositions to the cups through the pipe lengths under the action of a pressure drop between the upper and lower containers. The apparatus can be manufactured at lower cost and the process can be performed within a shorter time because the stirring to form the composition by stirring blades arranged in the upper container takes some more time, as a rule, than the external stirring by means of a powerful stirrer which is available on the market. In that connection it may be mentioned that a shortening of the processing time will also promote the quality of the casting molds, particularly if chemical accelerators are used. The following fact is of special significance in comparison with the apparatus described first hereinbefor: If the composition is stirred in the upper container, as is the case in the known apparatus, parts of the dry, unmixed powder mixture may enter one or more cups as they are filled. This is so because small quantities of the dry powder mixture may be deposited on the upper portions of the stirring blades and on the walls above the surface level of the composition which is being stirred in the upper container, i.e., in the upper portion of the upper container. During the filling operation, small shakes may cause the still dry material to fall into the stirred composition. Defects in the castings will be caused by such dry material when it has entered the cups.

DETAILED DESCRIPTION OF THE PREFERRED EMBODIMENT

Figure 1:
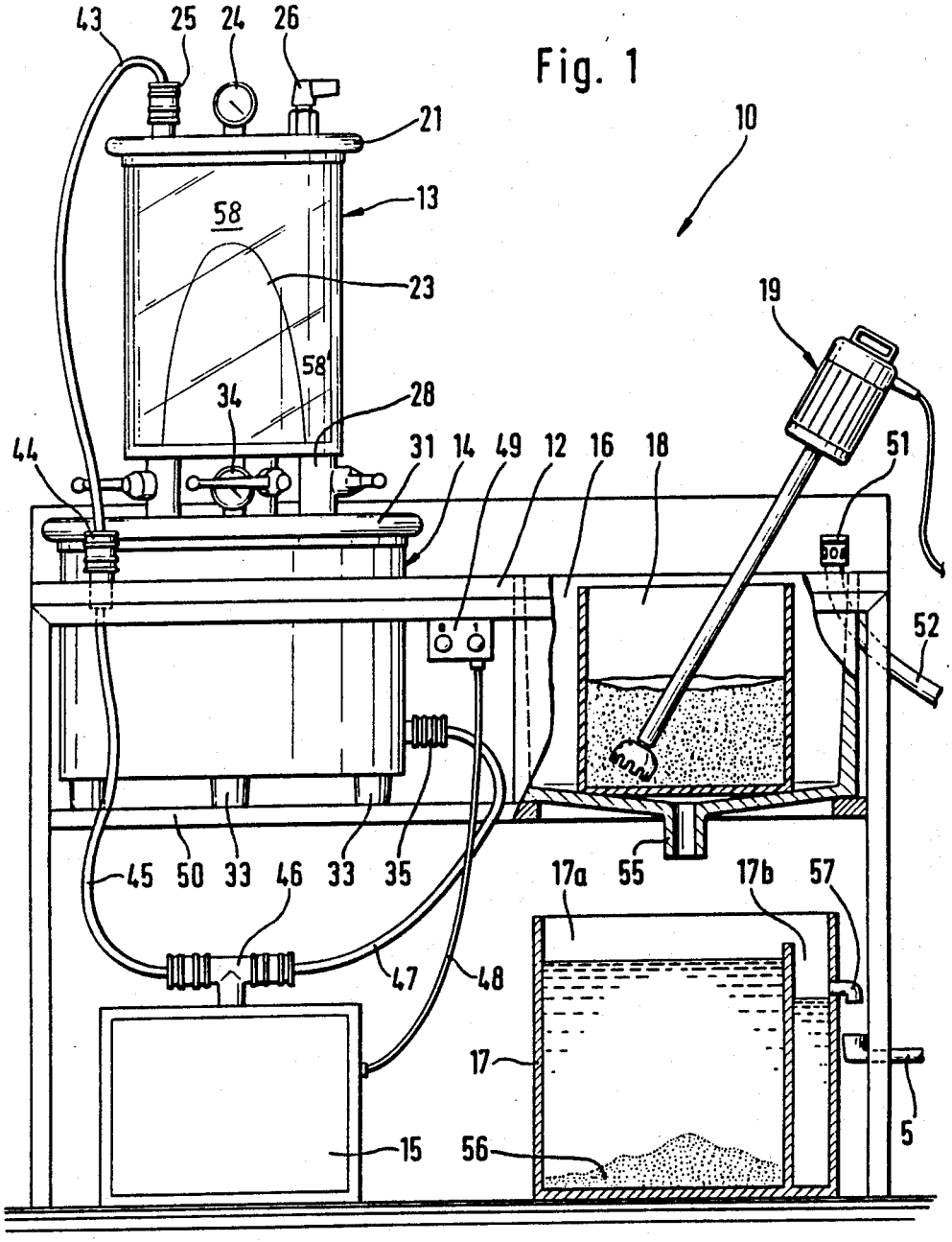
FIG. 1 is a side elevation showing the apparatus in an operative position, partly broken away.

An illustrative embodiment of the invention will now be described more in detail with reference to the drawing.

The apparatus 10 is used to make molds for making metal castings, e.g., to make molds for centrifugal casting or other casting processes, which molds are made by a lost-wax process. The casting molds are made from a liquid to paste composition, which in an aqueous phase contains, e.g., gypsum as a binder and at least one further mineral substance, particularly a high-temperature modification of quartz, usually described as cristobalite. The apparatus comprises means for mixing the composition and for filling the composition into vessels, such as cups 40, in which the composition sets to form the casting molds. Those devices are mounted on a bench 12 together with a vacuum pump and with cleaning devices. As is particularly apparent from FIGS. 1 and 3, two cylindrical containers 13 and 14 which are adapted to be vacuumtightly sealed are arranged one over the other on the bench. Said containers are interconnected by line sections 43, 45; 47, which are adapted to be shut off, to a vacuum pump 15. One line section 47 extends from one side of a tee fitting 46 that is mounted on the vacuum pump 15, and that line section 47 is connected to a vacuum port 35 of the lower container 14. The line section 45 extends from the other side of the tee fitting 46 and opens into a tubular port 44 that is provided in the top deck of the bench. From the tubular port 44, a further line section 43 extends to a tubular port 25 of the upper container 13, which is adapted to be tightly sealed by a cover 21 and a sealing ring 22. The reduced pressure in the container 13 can be eliminated by means of an air inlet plug valve 26 that is provided in the cover 21. The line sections 45 and 47 are adapted to be connected by couplings, which will automatically close the tubular ports when the line sections are detached. The cover 21 of the upper container 13 and the cover 31 of the lower container 14 are provided with respective manometers 24; 34, which will indicate the underpressure in the associated container. By means of feet 33 the container 14 is mounted on a lower deck of the bench 12. The two containers 13, 14 communicate with each other through vertical pipe lengths 28, which are arranged in a circular array. Each pipe length is adapted to be shut off by means of a shut-off valve, which consists of a ball plug valve. The inlets 27 of the pipe lengths 28 are mounted in the bottom of the container 13, as is particularly apparent from FIGS. 3 and 4. End portions 29 of the pipe lengths 28 extend into the interior of the lower container 14 and terminate over respective cylindrical cups 40. Each cup 40 consists of two interfitting parts consisting of a rubber base 41 and a cylindrical metal tube 42. The cups 40 are arranged in a circular array on a bottom 37 of a tray 36. The tray 36 with all cups 40 can be removed from and introduced into the lower container 14 by hand by means of a handle 38. The handle 38 has a shank, which has a screw-threaded extension 39 that is anchored in a central projection of the bottom 37. The lower container 14 has a cylindrical shell 30, which is immovably held in the frame of the bench 12. As is particularly apparent from FIG. 3, the switch 49 for the vacuum pump is mounted on the top deck of the bench and is connected to the vacuum pump by the cable 48. Beside the lower container 14, the lower deck of the bench 12 contains a cylindrical washbasin 16, which has an outlet fitting 55, which terminates over a collecting vessel 17, which stands on the floor. The collecting vessel 17 is divided into a main chamber **17*a* and an overflow chamber 17*b*. The latter is provided with an outlet fitting 57, which is connected to a water drain 5**.

Figure 3:
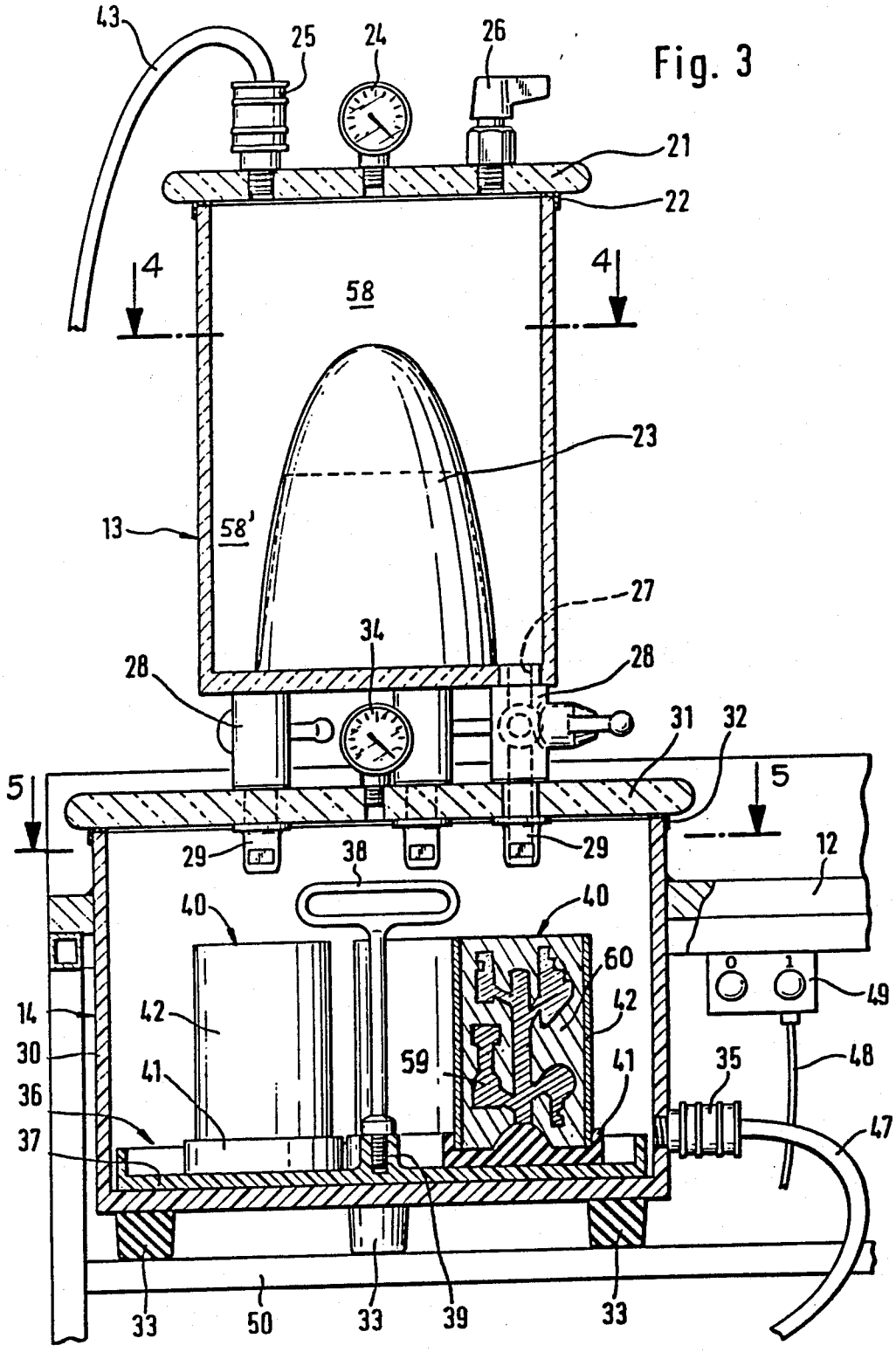
FIG. 3 is a vertical sectional view showing on a larger scale a detail of FIG. 1.
Figure 4:
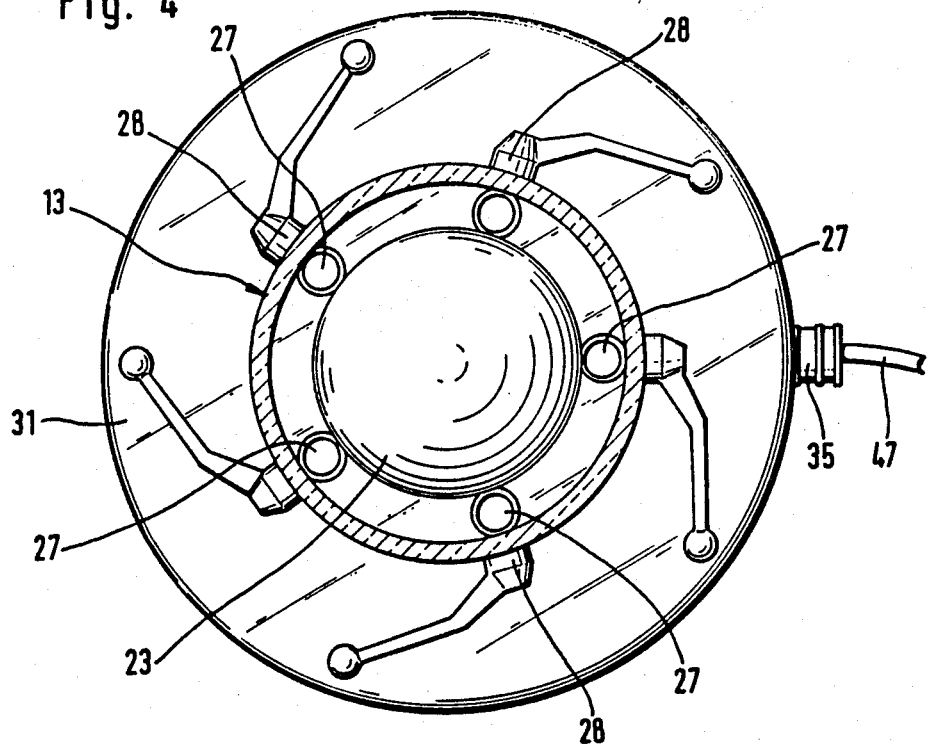
FIG. 4 is a horizontal sectional view taken on line IV—IV in FIG. 3.
Figure 5:
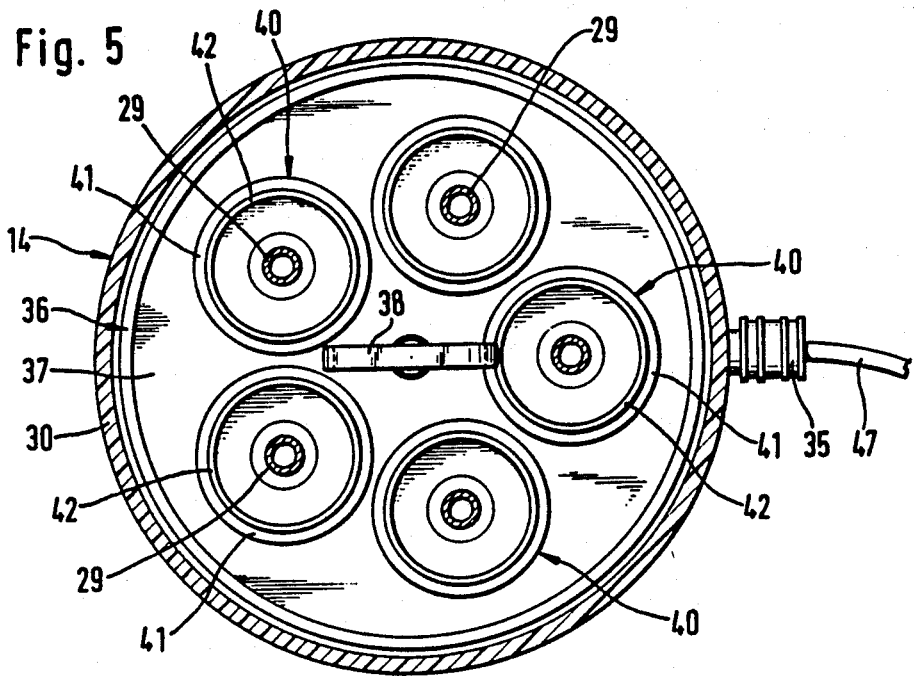
FIG. 5 is a horizontal sectional view taken on line V—V in FIG. 3.

A rotationally symmetrical flow guiding body 23 is provided in the upper container 13 and is rotationally symmetrical with respect to the axis of symmetry of the upper container 13. In the illustrative embodiment shown on the drawing the flow guiding body 23 has the shape of a hyperboloid of revolution that has a vertical longitudinal axis. The horizontal base surface of the flow guiding body 23 rests on the bottom of the container 13. Alternatively, the flow guiding body 23 may have the shape of a cone, which has a rounded apex and has a base surface which rests on the bottom of the container 13. Alternate shapes of the flow guiding body 23 may be hybrids of hyperboloidal and frusticonical shapes (FIG. 3). The flow guiding body 23 has a closed peripheral surface. A distributing space 58 which contains no internal fixtures is defined by the cylindrical shell of the upper container 13 and the peripheral surface of the flow guiding body 23 and extends from the cover 21 to the inlets 27 of the pipe lengths 28. Over said inlets 27 the distributing space 58 terminates in the form of an annular mouth space 58'. The flow guiding body 23 is preferably screw-connected to the bottom of the container 13 and extends into the upper half of the height of the container 13. In the lowermost one-third of the height of the flow guiding body 23 its peripheral surface includes with the vertical an angle which is smaller than 15 degrees.

Figure 2:
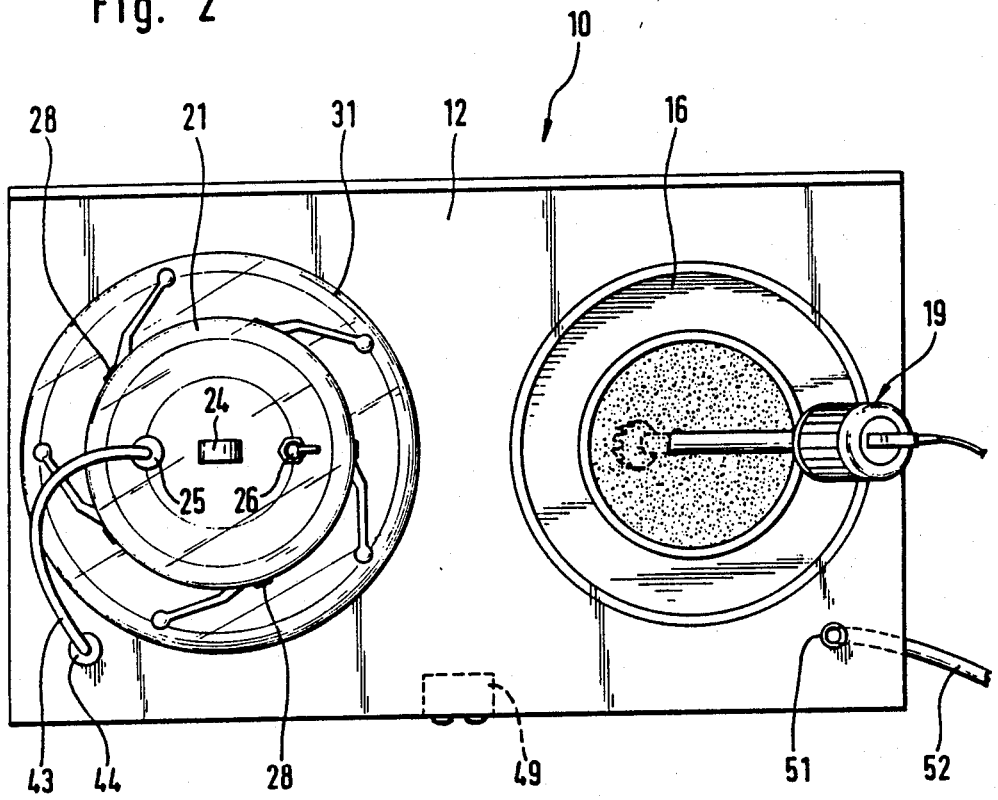
FIG. 2 is a top plan view showing the apparatus of FIG. 1.
Figure 6:
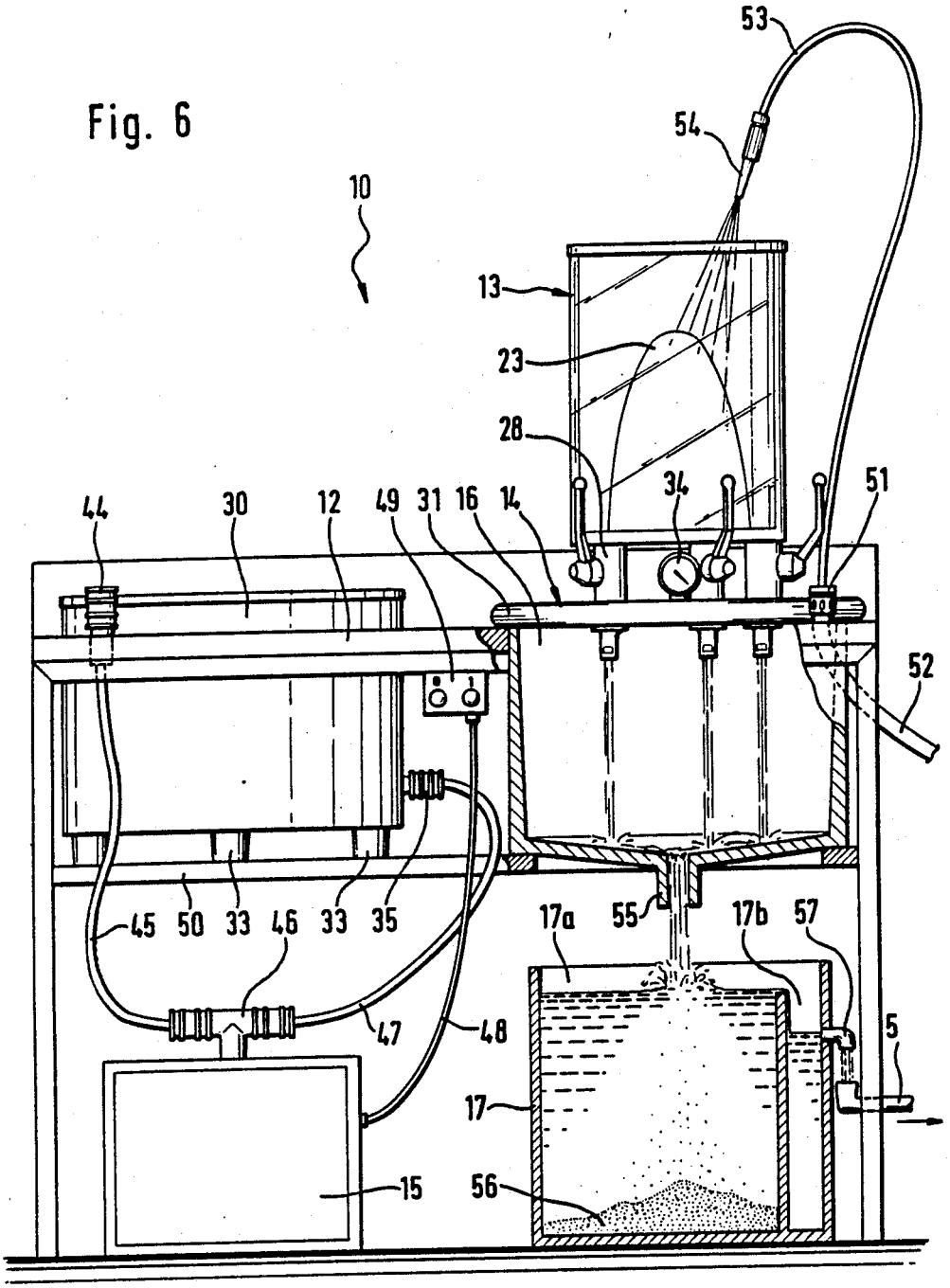
FIG. 6 is a view that is similar to FIG. 1 and shows the apparatus during the cleaning operation.

As a result, the mouth space 58' adjoining the inlets 27 is defined by an approximately vertical peripheral surface portion of the flow guiding body 23. The cover 31 rests via the sealing ring 32 on the top rim of the cylindrical shell 30 of the lower container 14 and is engaged on its underside by radial flanges of the end portions 29. As a result, the cover 31 is connected by the pipe lengths 28 to the upper container 13 to form a structural unit with the upper container 13 and the flow guiding body 23. That unit can be shifted as such from an operative position shown in FIGS. 1 to 3 to a cleaning position shown in FIG. 6. In that cleaning position that unit is arranged with the cover 31 resting on the top rim of the washbasin 16. That rim is designed like the top rim of the shell 30 of the lower container 14. A water supply line 52 is connected by a water port 51, which is adapted to be uncoupled, and a water hose 53 to a spray nozzle 54. As is apparent from FIG. 6 the pipe lengths 28 are open during the cleaning operation so that the dirty water can flow through the outlet fitting 55 of the washbasin 16 into the main chamber 17*a* of the collecting vessel 17. In that main chamber the coarse particles of the composition which have been flushed out settle to form a sediment 56. The water from which coarse solid particles have been removed flows through the overflow chamber 17*b* and the outlet fitting 57 into the drain 5.

The mode of operation of the apparatus will now be described: The cups 40 are placed in a circular array on the bottom 37 of the tray 36 when the latter is outside the container 14. By means of the handle 38 the tray 36 with the cups 40 thereon is introduced into the lower container 14. The unit consisting of the upper container 13, the pipe lengths 28 and the cover 31 is then placed on the cylindrical shell 30 of the lower container 14 in such a manner that the lower end portions 29 of the pipe lengths 28 terminate over respective cups. The ball plug valves in the pipe lengths 28 are closed at that time.

In a mixing trough 18 which has been placed into the washbasin 16 the components of the desired composition are then mixed to form the composition used to make the casting molds. That mixing is effected by a sufficiently powerful stirrer 19, which is commercially available. When the composition has been formed it is poured into the upper container, whereafter the cover 21 is applied and the vacuum pump 15 is started. The vacuum is established in the two containers 13, 14 at the same time. Under the reduced pressure, the air which is contained in the composition is sucked upwardly so that the composition rises to an extent that depends on its viscosity. The composition will subside approximately to the initial level as soon as the air has been removed. That operation takes about 120 seconds. The ball plug valves are then opened one after the other so that all cups can be filled almost at the same time. As soon as a cup 40 has been completely filled the associated ball plug valve is closed. When conventional compositions, which contain gypsum as a binder, are employed, the filling time will amount to about 60 seconds. As soon as the cups 40 have been completely filled the vacuum pump is deenergized and air is admitted to both containers 13, 14. The upper container is then rinsed in the position shown in FIG. 6. When compositions having a relatively high viscosity are to be filled into cups, the vacuum in the upper container 13 is separately eliminated so that air may be admitted to that container during the filling operation and a pressure drop can be set up between the upper and lower containers. That pressure drop will assist the flow of the composition through the pipe sections 28. If the external mixing takes about two minutes, the total time until the filling has been completed may be less than five minutes so that the aqueous and solid phases of the slurry will not segregate from each other. Such segregation is often the cause of defects in the castings.

Again with reference to FIG. 3 the right-hand cup 40 contains a wax tree 59 and the composition has been poured from the outlet end portion 29 into the cup 40 around the wax tree 59 and has been allowed to solidify in the cup 40 to form a casting mold 60. The wax tree is then melted and the molten wax is poured out of the mold 60.

I claim:

1. In a molding apparatus for making molds for making metal castings from a liquid to pasty composition which comprises an aqueous continuous phase, a binder and, in addition, at least one solid mineral component, said apparatus comprising an upper container and a lower container, which are concentrically arranged one over the other, and each of which comprises a bottom, a cylindrical shell rising from the bottom and having a top rim, and a cover mounted on said top rim and adapted to vacuumtightly seal said container, said shell of said upper container having a vertical portion adjacent to said bottom of said upper container, a vacuum pump, evacuating line means connecting said upper and lower containers to said vacuum pump, shut-off valve means for shutting off said evacuating line means, flow guiding means providing a flow guiding surface disposed in said upper container adjacent to said bottom thereof and defining with said shell of said upper container a distributing space, a plurality of cups, which are arranged in said lower container in a circular array, a plurality of pipe lengths, which are equal in number to said cups and arranged in a circular array and connect the interior of said upper container to the interior of said lower container and have respective inlets which are open to said distributing space to receive said composition therefrom and respective outlets, which are disposed in said lower container over respective ones of said cups to deliver said composition thereto, and a plurality of shut-off valves for shutting off respective ones of said pipe lengths, the improvement residing in that said flow guiding means comprise an approximately rotationally symmetrical guiding body, which is concentrically arranged in said upper container and has a closed peripheral surface which constitutes said flow guiding surface, said distributing space extends from said cover of said upper container as far as to said inlets of said pipe lengths, and said vertical portion of said shell of said upper container defines with said flow guiding surface in said distributing space an annular mouth space, which adjoins said inlets, wherein said flow guiding body has the shape of a hyperboloid, which has a vertical axis and a base surface resting on said bottom of said upper container.

2. In a molding apparatus for making molds for making metal castings from a liquid to pasty composition which comprises an aqueous continuous phase, a binder and, in addition, at least one solid mineral component, said apparatus comprising an upper container and a lower container, which are concentrically arranged one over the other, and each of which comprises a bottom, a cylindrical shell rising from the bottom and having a top rim, and a cover mounted on said top rim and adapted to vacuumtightly seal said container, said shell of said upper container having a vertical portion adjacent to said bottom of said upper container, a vacuum pump, evacuating line means connecting said upper and lower containers to said vacuum pump, shut-off valve means for shutting off said evacuating line means, flow guiding means providing a flow guiding surface disposed in said upper container adjacent to said bottom thereof and defining with said shell of said upper container a distributing space, a plurality of cups, which are arranged in said lower container in a circular array, a plurality of pipe lengths, which are equal in number to said cups and arranged in a circular array and connect the interior of said upper container to the interior of said lower container and have respective inlets which are open to said distributing space to receive said composition therefrom and respective outlets, which are disposed in said lower container over respective ones of said cups to deliver said composition thereto, and a plurality of shut-off valves for shutting off respective ones of said pipe lengths, the improvement residing in that said flow guiding means comprise an approximately rotationally symmetrical guiding body, which is concentrically arranged in said upper container and has a closed peripheral surface which constitutes said flow guiding surface, said distributing space extends from said cover of said upper container as far as to said inlets of said pipe lengths, and said vertical portion of said shell of said upper container defines with said flow guiding surface in said distributing space an annular mouth space, which adjoins said inlets, wherein said flow guiding body has a frustoconical lower portion and a hyperboloidal upper portion.

3. In a molding apparatus for making molds for making metal castings from a liquid to pasty composition which comprises an aqueous continuous phase, a binder and, in addition, at least one solid mineral component, said apparatus comprising an upper container and a lower container, which are concentrically arranged one over the other, and each of which comprises a bottom, a cylindrical shell rising from the bottom and having a top rim, and a cover mounted on said top rim and adapted to vacuumtightly seal said container, said shell of said upper container having a vertical portion adjacent to said bottom of said upper container, a vacuum pump, evacuating line means connecting said upper and lower containers to said vacuum pump, shut-off valve means for shutting off said evacuating line means, flow guiding means providing a flow guiding surface disposed in said upper container adjacent to said bottom thereof and defining with said shell of said upper container a distributing space, a plurality of cups, which are arranged in said lower container in a circular array, a plurality of pipe lengths, which are equal in number to said cups and arranged in a circular array and connect the interior of said upper container to the interior of said lower container and have respective inlets which are open to said distributing space to receive said composition therefrom and respective outlets, which are disposed in said lower container over respective ones of said cups to deliver said composition thereto, and a plurality of shut-off valves for shutting off respective ones of said pipe lengths, the improvement residing in that said flow guiding means comprise an approximately rotationally symmetrical guiding body, which is concentrically arranged in said upper container and has a closed peripheral surface which constitutes said flow guiding surface, said distributing space extends from said cover of said upper container as far as to said inlets of said pipe lengths, and said vertical portion of said shell of said upper container defines with said flow guiding surface in said distributing space an annular mouth space, which adjoins said inlets, wherein said flow guiding body extends upwardly into the upper one-half of the height of said upper container and wherein said peripheral surface of said flow guiding body in the lowermost one-third of its height includes an angle that is smaller than 15° with the vertical.

4. In a molding apparatus for making molds for making metal castings from a liquid to pasty composition which comprises an aqueous continuous phase, a binder and, in addition, at least one solid mineral component, said apparatus comprising an upper container and a lower container, which are concentrically arranged one over the other, and each of which comprises a bottom, a cylindrical shell rising from the bottom and having a top rim, and a cover mounted on said top rim and adapted to vacuumtightly seal said container, said shell of said upper container having a vertical portion adjacent to said bottom of said upper container, a vacuum pump, evacuating line means connecting said upper and lower containers to said vacuum pump, shut-off valve means for shutting off said evacuating line means, flow guiding means providing a flow guiding surface disposed in said upper container adjacent to said bottom thereof and defining with said shell of said upper container a distributing space, a plurality of cups, which are arranged in said lower container in a circular array, a plurality of pipe lengths, which are equal in number to said cups and arranged in a circular array and connect the interior of said upper container to the interior of said lower container and have respective inlets which are open to said distributing space to receive said composition therefrom and respective outlets, which are disposed in said lower container over respective ones of said cups to deliver said composition thereto, and a plurality of shut-off valves for shutting off respective ones of said pipe lengths, the improvement residing in that said flow guiding means comprise an approximately rotationally symmetrical guiding body, which is concentrically arranged in said upper container and has a closed peripheral surface which constitutes said flow guiding surface, said distributing space extends from said cover of said upper container as far as to said inlets of said pipe lengths, and said vertical portion of said shell of said upper container defines with said flow guiding surface in said distributing space an annular mouth space, which adjoins said inlets, wherein said flow guiding body has the shape of a cone which has a rounded apex and a base surface which rests on the bottom of the upper container.

5. The improvement set forth in claim 4 as applied to an apparatus for making molds for making metal castings from said composition which contains cristobalite as a solid mineral component.

6. The improvement set forth in claim 4, wherein said evacuating line means comprise two evacuating lines, which connect said upper and lower containers, respectively, to said vacuum pump, and said shut-off valve means comprise two shut-off valves for shutting off respective ones of said evacuating lines.

7. The improvement set forth in claim 4, wherein said flow guiding body is a solid body.

8. The improvement set forth in claim 4, wherein said upper container is adapted to be supplied with said composition which has been mixed only outside said upper container.

9. The improvement set forth in claim 4, wherein said upper container is free of means for agitating said composition in said upper container.

10. The improvement set forth in claim 4, wherein said upper container, said flow guiding body, said pipe lengths and said cover of said lower container are rigidly interconnected to constitute a unit, said lower container consists of a pot, and said unit is mounted on said top rim of said shell of said lower container and is adapted to be lifted therefrom.

11. The improvement set forth in claim 4, wherein said flow guiding body is of a highly polymerical material.

12. The improvement set forth in claim 4 wherein each of said pipe lengths has an upper end at which said respective inlet is located and which is at the same level as said bottom of said upper container.

* * * * *